United States Patent [19]

Jackson

[11] Patent Number: 4,819,540

[45] Date of Patent: Apr. 11, 1989

[54] WEAPON MOUNT USEFUL FOR COMBAT VEHICLE

[75] Inventor: Theodore A. Jackson, Utica, Mich.

[73] Assignee: Cadillac Gage Textron Inc., Warren, Mich.

[21] Appl. No.: 25,647

[22] Filed: Mar. 13, 1987

Related U.S. Application Data

[62] Division of Ser. No. 659,812, Oct. 11, 1984, abandoned.

[51] Int. Cl.[4] ..... F41D 11/06

[52] U.S. Cl. ..... 89/37.05; 89/37.11; 89/40.02

[58] Field of Search ..... 89/37.05, 37.13, 37.11, 89/37.17, 40.02, 40.03, 1.815, 37.01, 36.13, 37.02, 37.21, 37.07, 40.13; 292/293

[56] References Cited

U.S. PATENT DOCUMENTS

| | | | |
|---|---|---|---|
| 350,437 | 10/1886 | Kirchner et al. | 292/293 |
| 373,623 | 11/1887 | Vavasseur | 89/37.01 |
| 457,641 | 8/1891 | Fletcher | 89/37.01 |
| 814,859 | 8/1903 | Meigs et al. | 89/37.07 |
| 944,128 | 12/1909 | Faber | 89/36.13 |
| 1,073,061 | 9/1913 | Voller et al. | 89/37.07 |
| 1,671,454 | 5/1928 | Stoutenburgh | 292/293 |
| 2,218,881 | 10/1940 | Herlach | 89/40.13 |
| 2,444,334 | 6/1948 | Caulkins | 89/37.05 |
| 3,837,260 | 9/1974 | Agren et al. | 89/37.11 |

FOREIGN PATENT DOCUMENTS

| | | | |
|---|---|---|---|
| 684720 | 11/1939 | Fed. Rep. of Germany | 89/37.01 |
| 359455 | 1/1906 | France | 89/37.01 |
| 24610 | of 1895 | United Kingdom | 89/37.01 |

*Primary Examiner*—Deborah L. Kyle
*Assistant Examiner*—Stephen Johnson
*Attorney, Agent, or Firm*—Edward J. Timmer

[57] ABSTRACT

As applied to mounting a mortar in a combat vehicle, the mounting structure includes a weapon carriage supported on a support frame having one end hingedly mounted to the vehicle floor and another end releasably latched to cross-pins on the vehicle floor. The support frame includes a central pivot shaft and a peripheral roller track while the carriage includes a hollow hub receiving the pivot shaft and retractable spring biased ball rollers in rolling engagement on the track during rotation of the carriage for weapon repositioning. A spur gear is carried on the carriage and rotated by a hand crank and meshes with a stationary gear on the support frame to rotate the carriage about the pivot shaft. A clamping collar is provided on the pivot shaft to engage and force the carriage against the support frame with the ball rollers retracted to releasably lock the position of the weapon. The mortar mount is advantageous for its capability to absorb a greater portion of the mortar recoil energy, lessening the portion required to be absorbed by the vehicle suspension system.

12 Claims, 8 Drawing Sheets

250
255
258
32
256
254
252
257
16
14
18
18
10
20
24
12
22
26

WEAPON MOUNT USEFUL FOR COMBAT VEHICLE

This is a division of application Ser. No. 659,812, filed on Oct. 11, 1984, now abandoned.

FIELD OF THE INVENTION

The invention relates to shock absorbing mounting mechanisms and, in particular, to a mounting structure for a mortar or other weapon.

BACKGROUND OF THE INVENTION

In the past, mortars have been mounted in mobile combat vehicles. The mortar base typically was fastened to the floor of the vehicle on rubber or other shock absorbing pads to absorb part of the recoil energy of the mortar. The tires and suspension of the vehicle were required to absorb essentially the remainder of the recoil energy and often sustained damage as a result of firing the mortar.

What is needed is a mounting structure for a weapon such as a mortar for absorbing and dissipating more of the recoil energy and lessening the force required to be absorbed by the vehicle tires and suspension.

SUMMARY OF THE INVENTION

The invention contemplates a shock absorbing mount such as weapon mounting structure, which in a typical working embodiment includes a carriage or support member and a shock absorbing assembly on the carriage member and having a slide member adapted to receive the recoil end of a weapon, such as a mortar, or other shock transmitting means, and having pin means affixed thereto for movement therewith with the pin means spacing the slide member from the carriage member and having ends slidably received in the carriage member. The assembly includes a shock absorber member between the slide member and carriage member to independently absorb or dissipate a substantial portion of the recoil energy as the slide member moves toward the carriage from recoil force as guided by the pin means sliding into the carriage member.

The invention also contemplates such a weapon mounting structure in which the weapon carriage is mounted on a support track by a central pivot means for rotation relative to the track and includes retractible roller means engaged on the track during rotation and retracted into the carriage when the carriage is releasably clamped against the track during weapon firing by carriage clamping means. A gear train is provided between the carriage and a support frame so that the weapon carriage can be rotated manually or by other means relative to the track to vary position of the weapon.

The invention further contemplates a weapon carriage support frame having one end hingedly attached to a vehicle frame and the other end releasably latched against cross-pins on the vehicle frame so that the carriage support frame can be lifted about the hinged end to gain access to vehicle compartments therebelow.

DESCRIPTION OF PREFERRED EMBODIMENTS

Figures 1, 8:
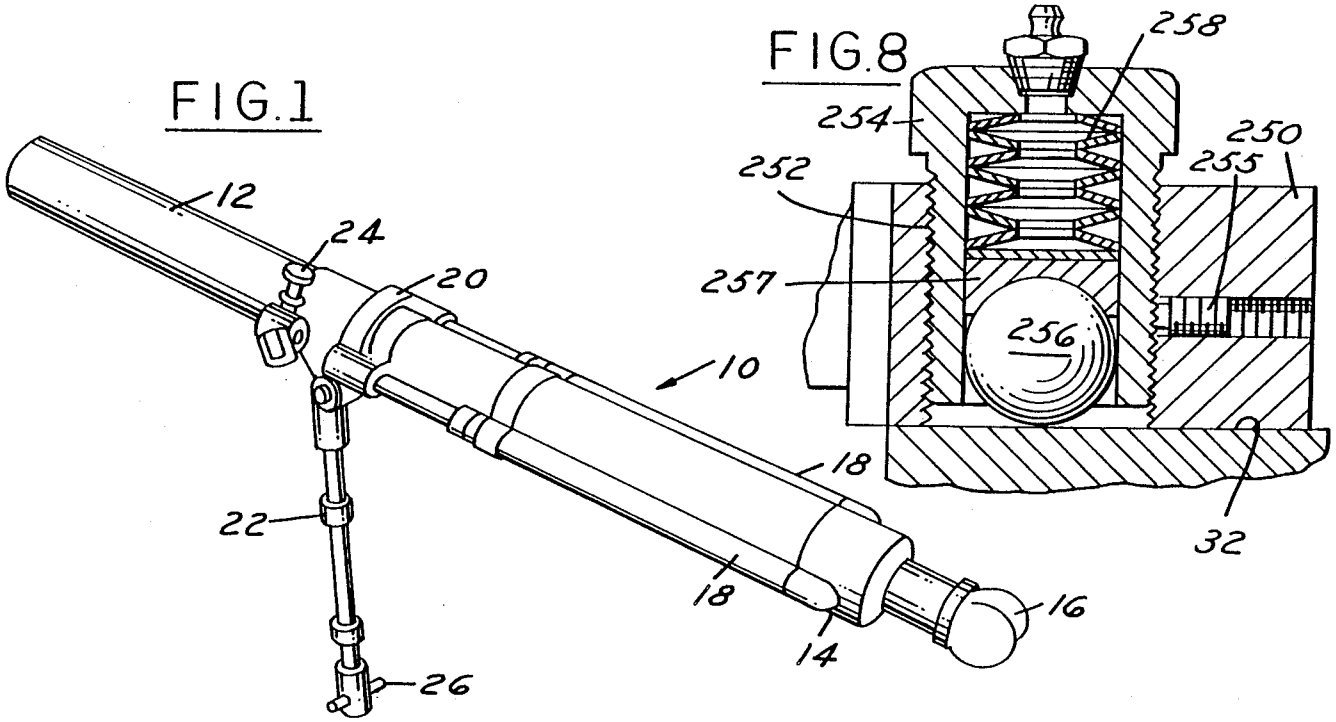
FIG. 1 is a perspective view of a mortar.
FIG. 8 is a partial sectional view along lines 8—8 of FIG. 3.
Figure 2A:
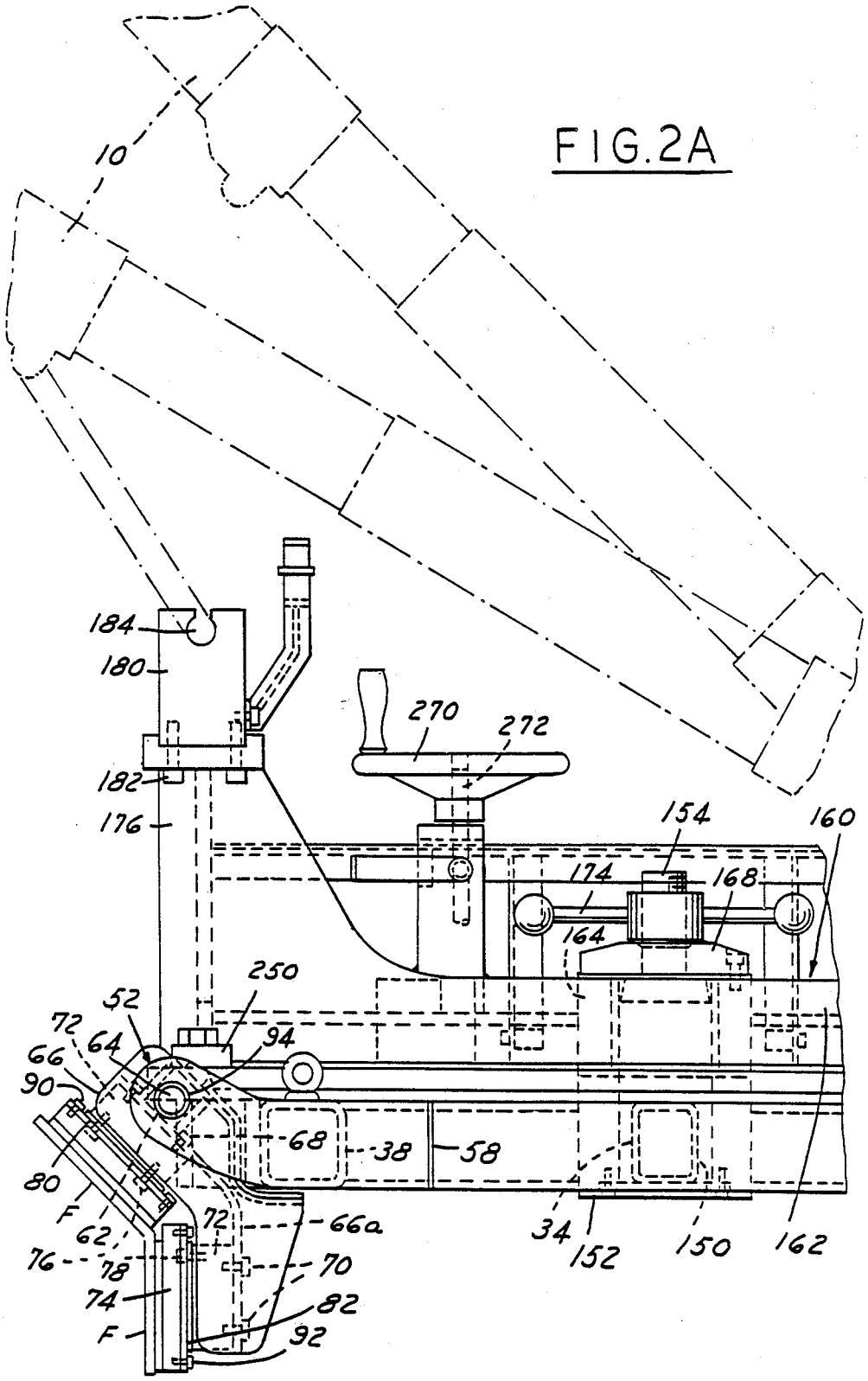
FIGS. 2A and 2B together constitute a side elevation of the mortar mounting structure.
Figure 2B:
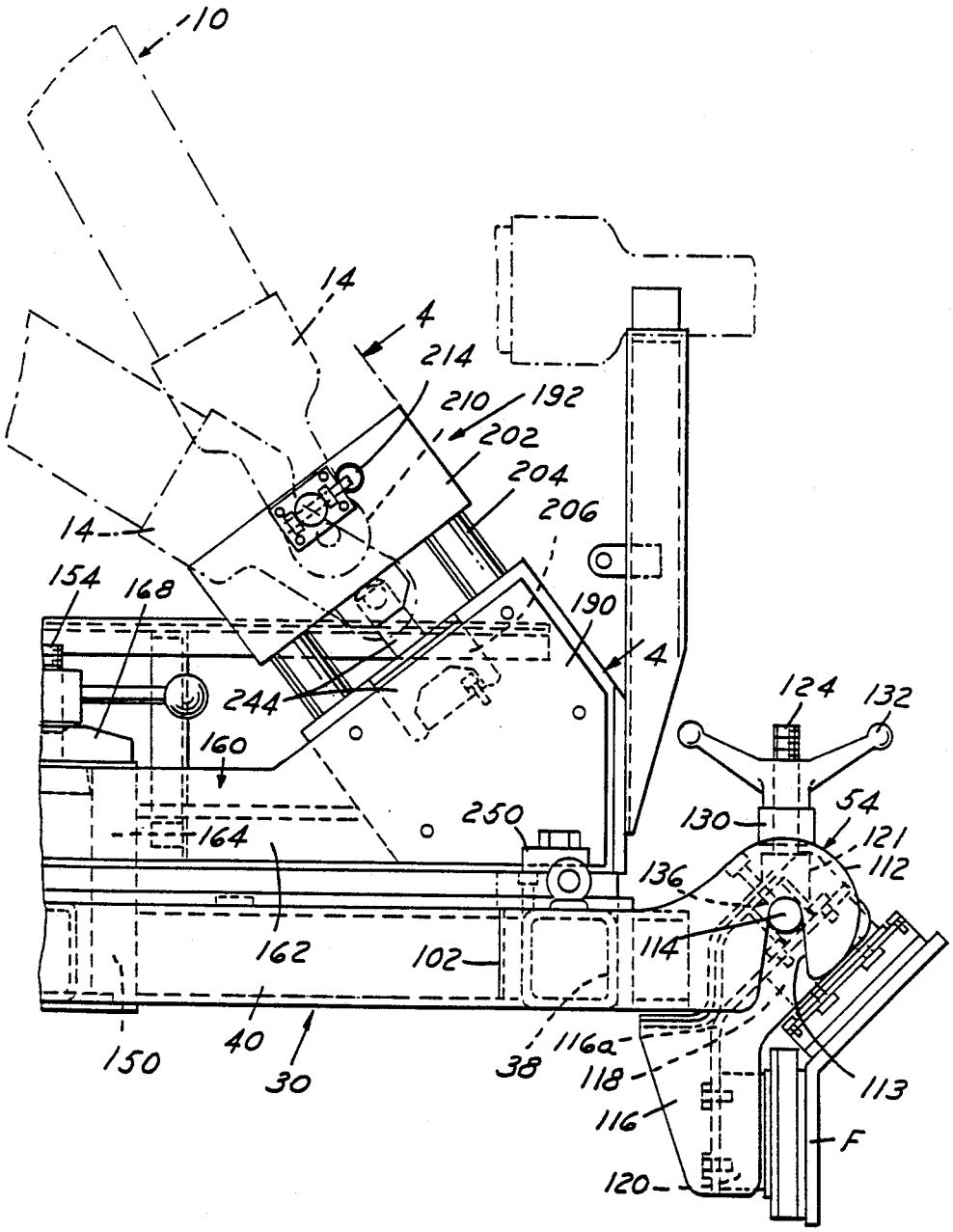
Figure 3A:
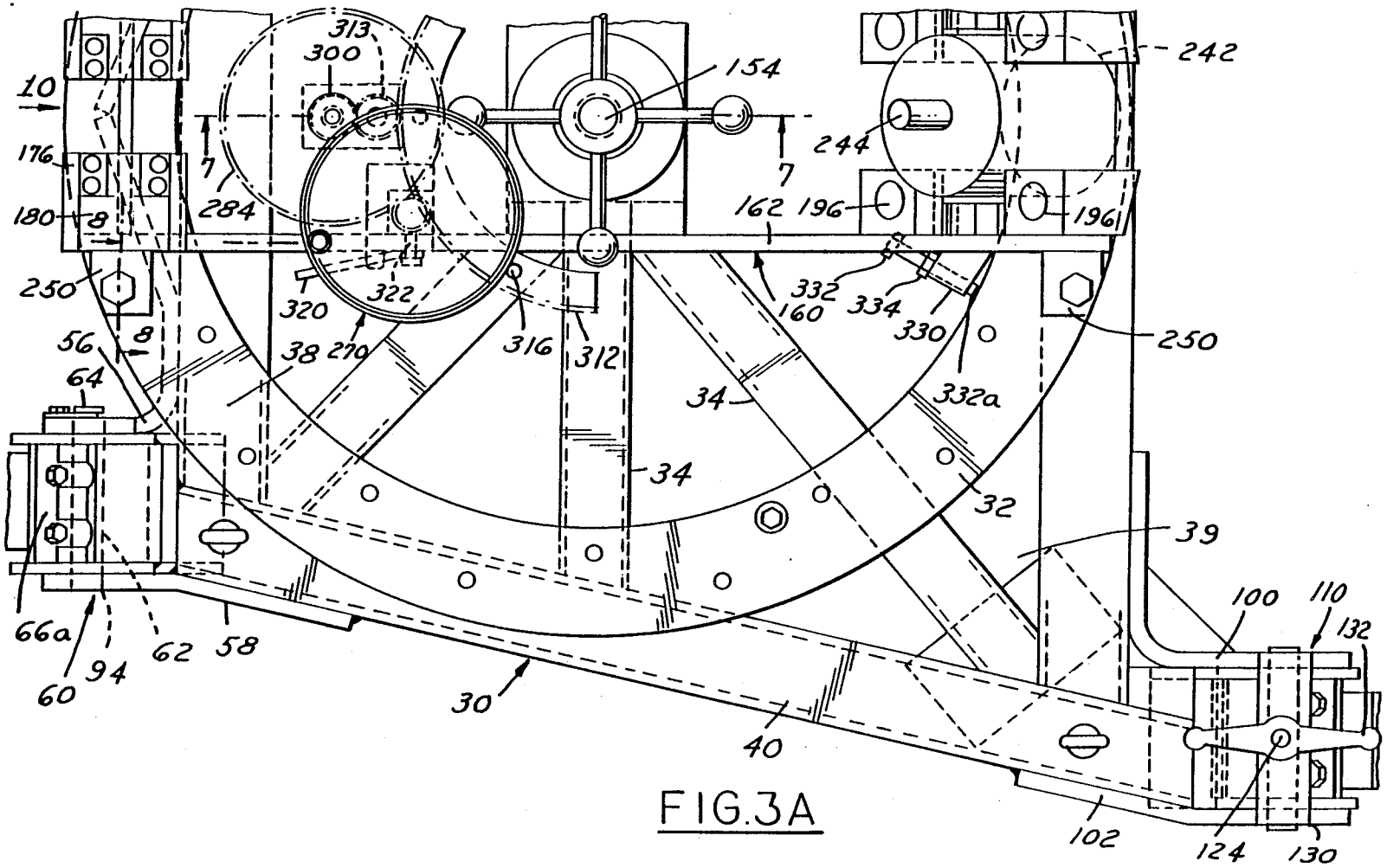
FIGS. 3A and 3B together constitute a plan view of the mortar mounting structure.
Figure 3B:
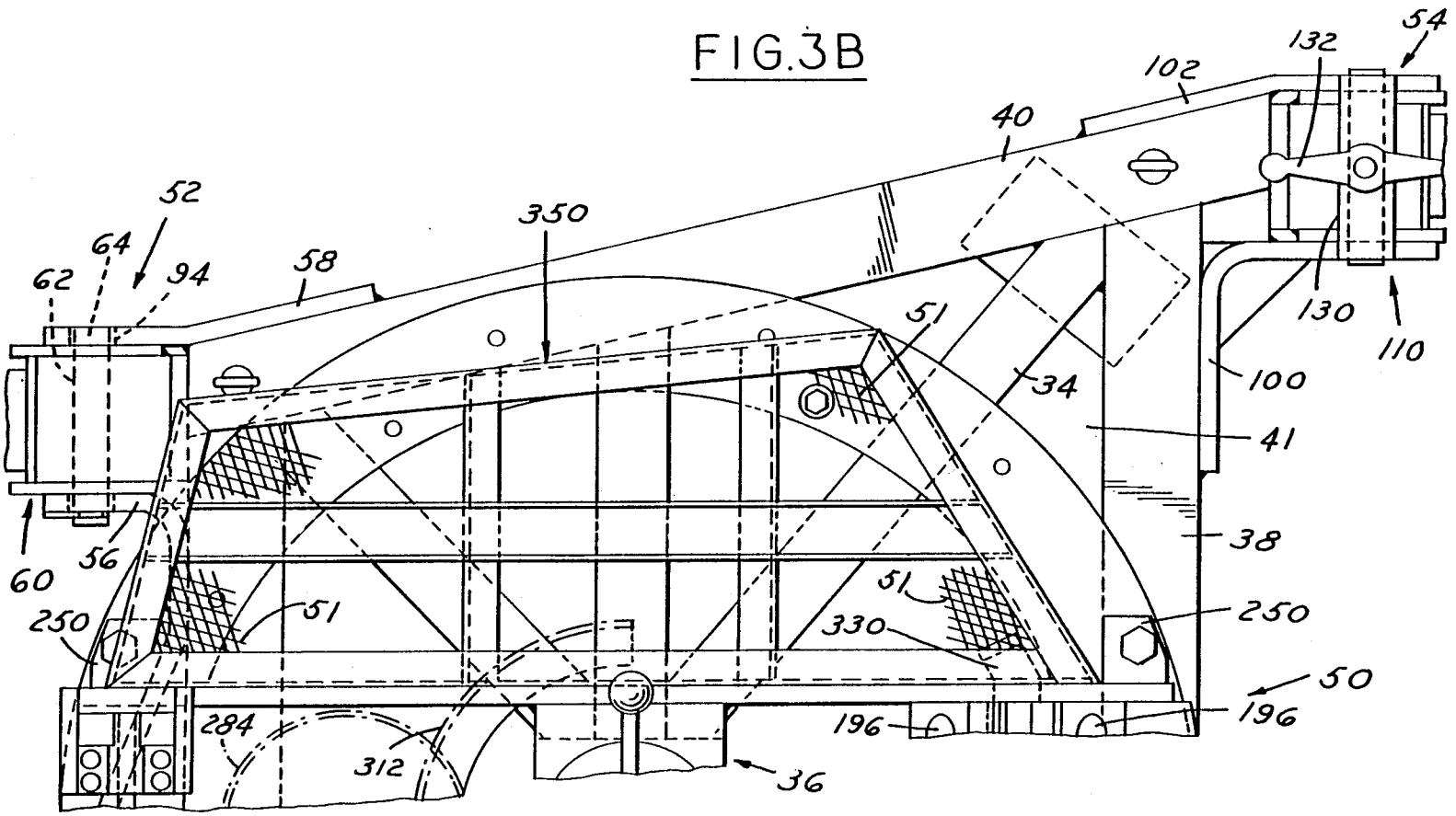

FIG. 1 illustrates a mortar 10 to which the invention is applicable but not limited. The mortar is a conventional 4.2 inch M30 mortar having a barrel or tube 12 which terminates at one end in a tube end cap 14 having a double bulbous configuration and trunnion pins 16 extending oppositely therefrom. As is well known, shock absorbers 18 are mounted on the mortar by collar 20 and by the tube end cap 14. An elevation mechanism 22 is shown schematically and attached to a coupling 24 on the mortar tube. The end of the elevation mechanism includes trunnion pins 26 extending oppositely for mounting purposes as will be explained herebelow.

FIGS. 2A–2B and 3A–3B show a mortar mounting structure in accordance with the invention for mounting the M30 mortar of FIG. 1 in a wheeled combat vehicle, such as the V150 armored vehicle manufactured by Cadillac Gage Company, Warren, Mich. The mounting structure includes a support frame 30 having an annular track member 32 supported on spoke members 34 welded at their inner end to a central pivot support housing 36 and at their outer ends to the hollow tubular frame members 38 and 40. Corner braces 39 and 41 are welded in place for additional support. As shown in FIG. 3, the cross frame members 38 and longitudinal frame members 40 are welded together to form a trapezoidal outer frame 50 in plan view. A wire screen 51 is welded onto the support 30 to provide a floor for the mounting structure, FIG. 9.

The outer frame 50 includes one end 52 hingedly mounted to the floor F of a combat vehicle and another end 54 releasably latched thereto, as will be described hereinafter. The hinged end 52 includes generally right angled inner brackets 56 welded to the cross members 38 as shown best in FIG. 3. Outer brackets 58 are welded to longitudinal members 40. Each set of brackets 56 and 58 extends in spaced apart parallel relation away from the frame 50 to form a pair of hinges 60 with aligned cross-holes 62 adapted to receive a cross pin 64. The cross-pin 64 is affixed by a pin support 66 to the floor F of the vehicle. In particular, each cross-pin is carried by pin support 66 which includes a flange **66*a* attached by multiple machine screws 68 and 70 to shock absorbing pads 72 and 74. The pads 72 and 74 are in turn attached by multiple machine screws 76 and 78 to pad support plates 80 and 82. Pad support plates 80 and 82 are affixed to mounting plates 86 and 88 by machine screws 90 and 92. Mounting plates 86 and 88 are welded or otherwise attached to the floor F of the combat vehicle. The opposite ends of the cross-pins 64 are mounted in the hinges 60 by headless bushings 94** as shown.

FIGS. 2A–2B and 3A–3B illustrate that the releasably latched end 54 of outer frame 50 includes angled brackets 100 welded to cross frame member 38 and oblique brackets 102 welded to longitudinal frame members 40 to form a pair of latches 110 having a hook 112 with a slot 113 to receive a cross-pin 114 supported on the vehicle floor F. Each cross-pin 114 is supported on the vehicle floor by a pin support 116 which is mounted on shock absorbing pads 118,120 in the same manner that the pin support is mounted as described above. The cross pin support 116 also includes a releasable latch mechanism having a cross member 121 on flange 116*a* of the pin support 116 extending between latch brackets 100,102 and an upright threaded shaft 124 extending from the cross member 120. Threaded onto the shaft 124 above the latches 110 is a lock member 130. Lock member 130 extends laterally or cross-wise to an overlying relation over brackets 100 and 102. The lock member is clamped against the tops of brackets 100 and 102 by turning or rotating hand wheel 132 on shaft 124. In particular, a machine screw 136 on the cross-pin support 116 is brought to bear against the cross pin 114 and the cross-pin is snugly received in slot 113 of the latch hook 112. The latches 110 are releasably clamped onto cross pins 114 simply by rotating the hand wheel 132 until the lock member 130 securely engages the tops of brackets 100 and 102. Rotating the hand wheel 132 is the opposite direction will release the lock member 130 from the brackets 100 and 102 to effect unclamping and when the lock member 130 is rotated between the brackets 100 and 102 out of the way, the outer frame 50 can be lifted at the end 54 with the other end 52 pivotably connected to the vehicle floor. By pivoting the end 54 upwardly, access can be had to compartments of the vehicle, such as the engine or drive train compartments, located below the outer frame 50.

As mentioned hereinabove, spoke members 34 are welded at their inner ends to a pivot support housing 36. An upright pivot pin 150 is supported in the pivot support housing 36 by a bottom plate 152 fastened thereto. The pivot pin 150 extends upwardly above the annular track and terminates in a threaded shaft 154 of smaller diameter for purposes to be explained herebelow.

Figure 7:
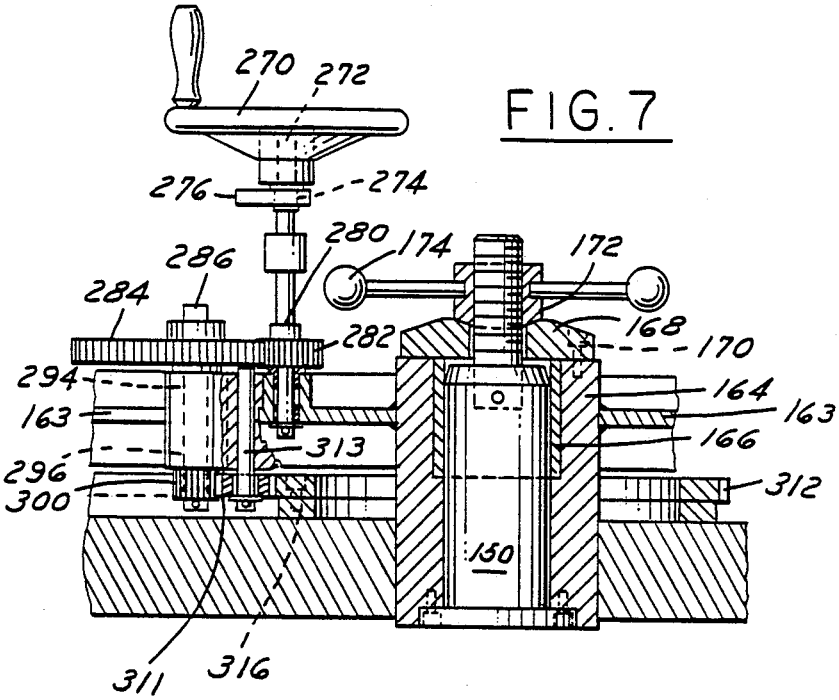
FIG. 7 is a sectional view along lines 7—7 of FIG. 3.

Rotatable about the pivot pin 150 on annular track member 32 is mortar or weapon carriage 160. The carriage 160 includes an elongated frame 162 having a floor 163 and hollow central hub 164 in which a tubular bushing 166 is positioned to rotatably receive pivot pin 150, FIGS. 2 and 7. A cap 168 is attached by multiple machine screws 170 to the top of carriage hub 164 and is engaged by collar 172 on a hand wheel 174 for purposes to be explained. Collar 172 is threadedly received on threaded shaft 154 extending from the pivot pin.

One end of the carriage 160 includes an elevated pedestal 176 having an anchor block 180 attached thereto by machine screws 182. The anchor block includes transverse bores 184 open at the top to receive the trunnion pins 26 of the mortar elevating mechanism 22 for supporting the elevating mechanism.

The opposite diametral end of the carriage 160 includes an angled mounting base 190 for supporting shock absorbing assembly 192. The mounting base 190 includes a central chamber 194 and four bores 196 arranged in a rectangular array. Each bore 196 has a tubular bushing 200 disposed therein, FIG. 6.

Figure 5:
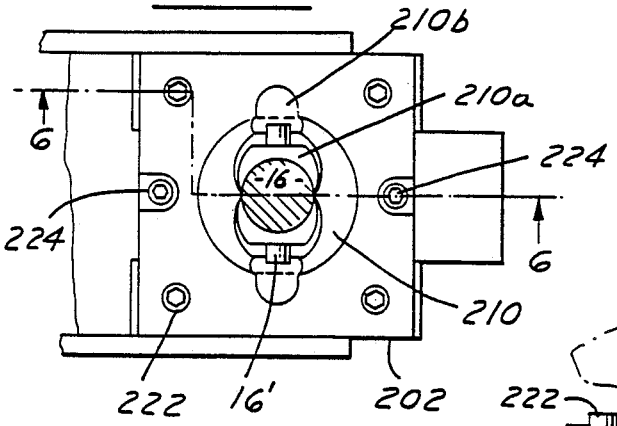
FIG. 5 is a plan view of the shock absorbing slide assembly.
Figure 4:
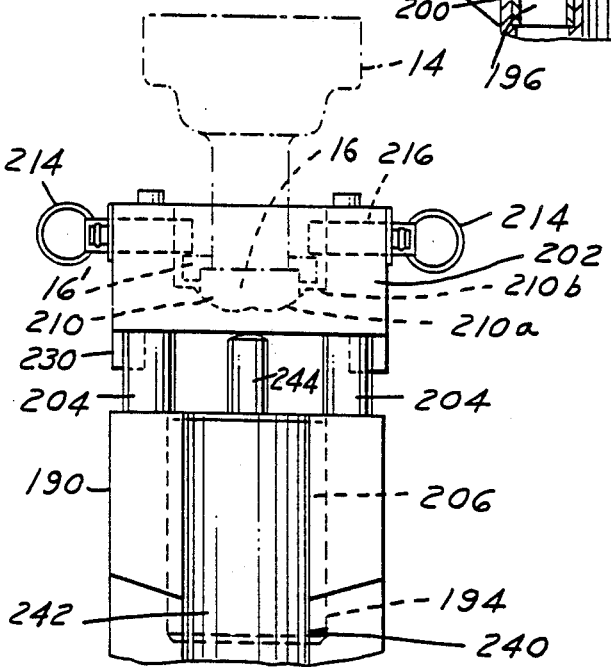
FIG. 4 is an elevation in the direction of arrows 4 in FIG. 2 of the shock absorbing assembly

The shock absorbing assembly 192 is comprised of a slide member 202, four cylindrical shafts or pins 204 and shock absorber 206. The slide member 202 on the side facing away from the base 190 includes a socket cavity 210 configured to supportively receive the bulbous end cap 14 of the mortar. The cavity 210 includes bulbous portion 210*a* complementary in configuration to the bulbous end of the mortar, FIGS. 4 and 5, and a cylindrical portion 210*b* to receive the trunnion pins 16, of the bulbous end cap 16. A pair of lock pins 214 are positioned in transverse bores 216 of the slide member to lock the trunnion pins 16 therein and prevent the end of the mortar from escaping from the socket cavity 210.

Figure 6:
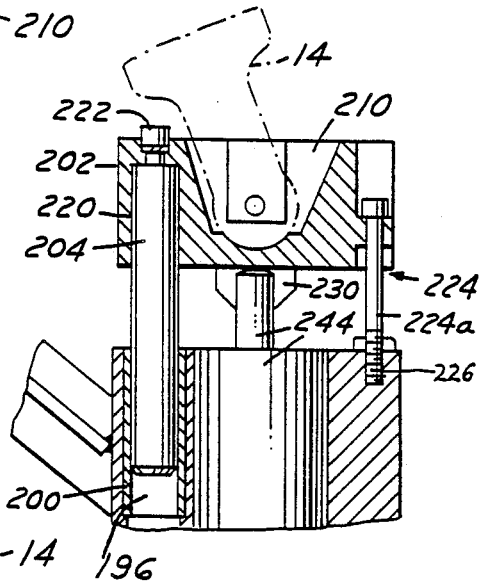
FIG. 6 is a sectional view along lines 6—6 of FIG. 5.

FIG. 6 illustrates that each shaft or pin 204 is received in a counterbore 220 in the slide member 202 and fastened therein by machine screws 222 threadably engaged with the end of each shaft. The opposite end of each shaft or pin 204 is slidably received in bushing 200 in bore 196 in the mounting base 190. In addition to shafts 204, the slide member also includes a pair of long bolts 224 disposed on opposite sides of the slide member and extending to and threadably received in threaded bores 226 in the mounting base 190. The bolts 224 include a smooth threadless shank 224*a*. It is apparent that recoil force of the mortar when mounted on the slide member will cause the slide member to move toward the mounting base by means of shafts 204 sliding into bushings 200 in bores 196 in the mounting base. However, bolts 224 do not slide with the slide member and to this end include the smooth shank to permit relative sliding movement between the slide member and bolts.

Figure 9:
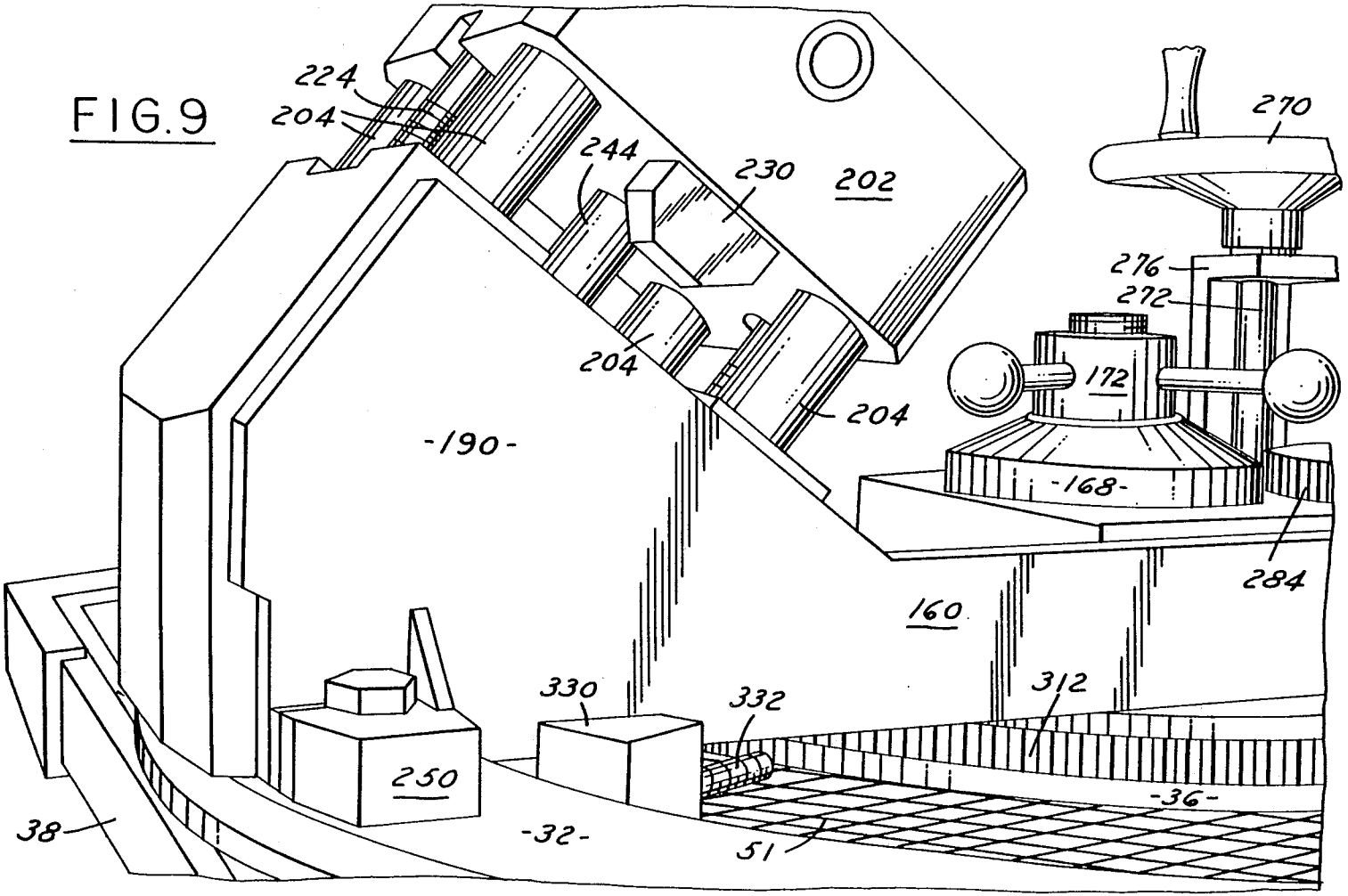
FIG. 9 is a partial perspective of the mortar mounting structure showing the shock absorbing assembly.

As shown best in FIG. 9, stop members 230 (only one shown) are affixed to the side of slide member facing the mounting base 190 to limit the extent of sliding movement, in particular to prevent shafts 204 from striking the bottom of bores 196 on the mounting base.

The central chamber 194 in the mounting base receives a recoil shock absorber 240 having a main body 242 received in the chamber and a slidable piston or plunger 244 extending from the main body to the facing side of the slide member 202. A suitable recoil shock absorber is manufactured by Taylor Devices, 200 Michigan Ave., North Tonawanda, N.Y., 14120 and includes compressible oil on which the plunger acts. The plunger 244 of the shock absorber is biased slightly toward the main body during assembly by tightening the long bolts 224.

In operation upon firing the mortar, the slide member 202 is driven toward the mounting base by the recoil force. Movement of the slide member toward the mounting base is guided by the shafts 204, sliding into bushings 200. Also, the shafts 204 absorb components of the recoil energy which are not directly coaxial with the axis of the plunger 244 to protect the latter against damage from such off-axis recoil forces. These forces arise when the elevation of the mortar tube is changed from coaxial alignment with the shock absorber plunger 244. The shafts 204 are sized to withstand these off-axis forces.

Of course, as soon as the slide member is driven toward the mounting base 190, the plunger 244 is pushed into the main body and an initial substantial portion of the recoil force is dissipated or absorbed by the shock absorber. The slide member is driven toward the mounting base until stop members 230 contact the mounting base. The remaining coil energy is absorbed by the shock absorbing pads 72,74 and others by which the outer frame 50 is mounted to the vehicle floor F and also by the vehicle suspension.

During operation of the mortar, there is a need to traverse the mortar. To this end, the carriage 160 includes a pair of transversely projecting flanges 250 adjacent each end with the flanges having a threaded bore 252 onto which a hollow threaded retainer 254 is threadably engages and retained by a set screw 255, FIG. 8. A retractible steel ball 256 is held in place by a ball roller puck 257 and a series of spring washers 258 which bias the puck and ball roller toward and in engagement with the annular track. The spring force is selected to reduce frictional forces between the mating surfaces of the carriage and annular track sufficiently to permit rotation by the gear mechanism described herebelow.

During weapon firing, the hand wheel 174 is rotated on shaft 154 to cause collar 172 to bear against the carriage hub 164 and thereby force the carriage toward the annular track 32 to increase friction forces sufficiently to lock the angular position of the carriage. In the locked position, the ball rollers are retracted into the retainer 254 against spring bias. When the carriage is rotated to adjust azimuth, the hand wheel 174 is rotated in the opposite direction, allowing the spring ball rollers 256 to reduce friction for rotative movement Rotation of the carriage 160 about pivot pin 150 is effected by hand crank 270 attached to shaft 272. The shaft 272 is supported adjacent the upper end by bushing 274 in support flange 276 rigidly attached to the carriage.

Held on the shaft 272 by pin 280 is a small diameter spur gear 282. Spur gear 282 intermeshes with a larger diameter spur gear 284 pinned on rotatable shaft 286. Shaft 286 is rotatably mounted on the carriage floor plate 163 by bushings 294,296.

A small diameter spur gear 300 is keyed on the lower end of shaft 286 by a Woodruf key and intermeshes with an idler gear 311 on rotatable shaft 313 which in turn meshes with a stationary gear 312 affixed to the spoke members 34 of the frame 30 by multiple machine screws 316.

Rotation of the hand cranks 270 thus causes rotation of the spur gear train relative to the stationary gear 312 and rotative movement of the carriage 160 on annular track 32 with ball roller 256 reducing friction sufficiently to permit such movement.

Figure 10:
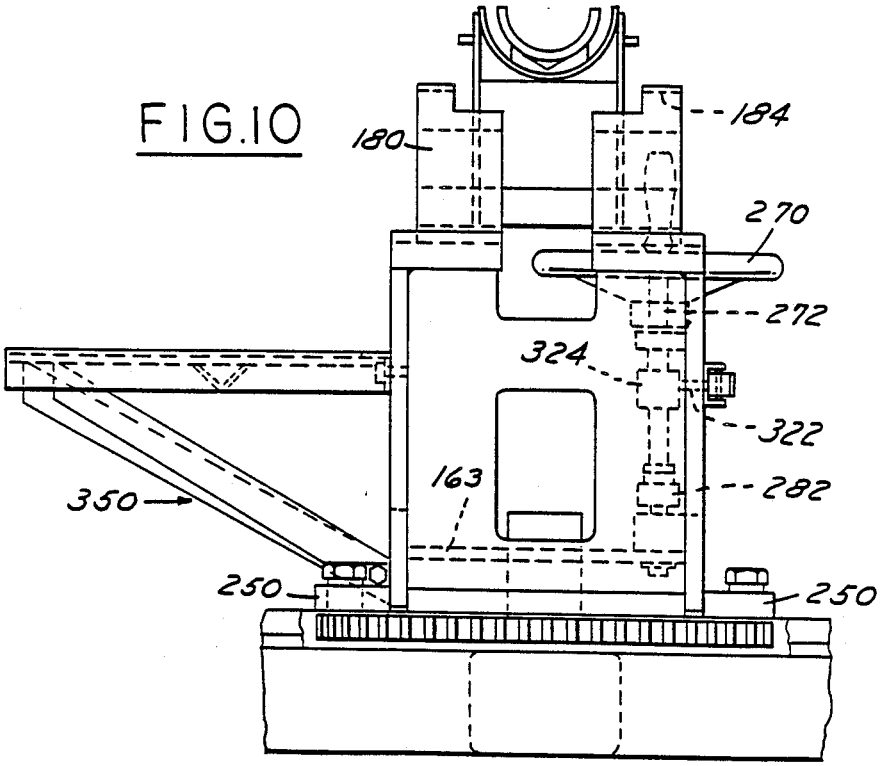
FIG. 10 is a front elevation of the mortar mounting structure in the direction of arrows 10 in FIG. 3.

While the carriage 160 is rotatably positioned to place the mortar at the desired azimuth, a lever 320 mounted on the carriage is pressed to disengage azimuth lock member 322 from one apertured azimuth lock 324 carried on shaft 272, FIG. 10. When the mortar is at the desired azimuth setting, the lever 320 is released, causing the locking member 322 to enter an aperture on the lock 324 to fix and lock the position.

The carriage 160 also includes a pair of transverse brackets 330 adjacent the mounting base of FIGS. 3 and 9. The brackets 330 each carry a machine screw 332 and jam nut 334. The machine screw is adjusted and locked by the jam nut so that its tip 332*a* is slightly spaced radially from the inner circumference of the annular track 32 as shown. This permits carriage rotation for azimuth adjustment and yet limits the amount of diametral movement of the carriage relative to the track from motor recoil forces in the event the recoil force exceeds the carriage locking force provided by hand wheel 174 and locking collar 172.

As shown in FIG. 10, a mortar loading stand or frame 350 is affixed to a side of the weapon carriage 160 opposite from the azimuth lock to facilitate loading of the mortar with ammunition.

While certain specific and preferred embodiments of the invention have been described in detail hereinabove, those skilled in the art will recognize that various modifications and changes can be made therein within the scope of the appended claims which are intended to include equivalents of such embodiments.

I claim:

1. A weapon mount comprising a support frame with an annular track, a weapon carriage supported on the support frame and having retractible roller means for engaging said track, means on the carriage for biasing the roller means toward the track, pivot means disposed centrally of said track between the support frame and the carriage for permitting relative rotation therebetween with the roller means and the track in engagement, and means on said pivot means for clamping the carriage and the support frame together with the roller means retracted against the bias of the biasing means to releasably lock the relative position of the carriage and the support frame during weapon firing.

2. The weapon mount of claim 1 wherein the weapon carriage includes a hollow central hub and said pivot means comprises a pivot shaft on the support frame received in the hollow hub.

3. The weapon mount of claim 2 wherein a hollow bushing is disposed in the hollow hub and receives said pivot shaft.

4. The weapon mount of claim 2 wherein the clamping means comprises a threaded shaft extending from said pivot means past the hub and a threaded collar threadably engaged on the pivot shaft and threadable in a direction to force the carriage against the support frame and retract the retractible roller means.

5. The weapon mount of claim 1 wherein the retractible roller means comprises spring biased balls disposed in counterbores in the carriage.

6. The weapon mount of claim 1 wherein the weapon carriage includes stop means for limiting movement between the weapon carriage and said support frame in a direction transverse to the longitudinal axis of said pivot means so as to prevent damage to said pivot means.

7. The weapon mount of claim 1 wherein a gear train is carried between the weapon carriage and the support frame and includes means for effecting relative rotation between the weapon carriage and the support frame by said gear train.

8. The weapon mount of claim 7 wherein the weapon carriage carries a spur gear and the support frame includes a stationary gear with which the, spur gear is inter-meshed to cause rotation of the weapon carriage relative to the support frame.

9. The weapon mount of claim 8 wherein the weapon carriage carries a hand wheel connected to the spur gear to cause same to inter-mesh and rotate relative to the stationary gear.

10. The weapon mount of claim 1 wherein the support frame is hingedly mounted to a vehicle frame at one end and releasably latched to cross-pin means on the vehicle frame at another end.

11. The weapon mount of claim 10 wherein said another end of the support frame means includes a hook portion which engages the cross-pin means and a releasable wing nut locking means is carried on the cross-pin means and includes a locking clamp engaging the hook portion against the cross-pin means.

12. A combat vehicle including the weapon mount of claim 1.

* * * * *